US006965292B2

(12) United States Patent
Ciarcia et al.

(10) Patent No.: US 6,965,292 B2
(45) Date of Patent: Nov. 15, 2005

(54) ISOLATION CAP AND BUSHING FOR CIRCUIT BREAKER ROTOR ASSEMBLY

(75) Inventors: Ronald Ciarcia, Bristol, CT (US); Ananthram Subramanian, Secunderabad (IN); Macha Narender, Chikkadapally-20 (IN); Luis Brignoni, Toa Baja, PR (US); Samuel Kim, Bristol, CT (US); Paul Lafferty, Farmington, CT (US)

(73) Assignee: General Electric Company, Schenectady, NY (US)

( * ) Notice: Subject to any disclaimer, the term of this patent is extended or adjusted under 35 U.S.C. 154(b) by 28 days.

(21) Appl. No.: 10/652,357

(22) Filed: Aug. 29, 2003

(65) Prior Publication Data

US 2005/0046539 A1 Mar. 3, 2005

(51) Int. Cl.[7] ..... H01H 61/01; H01H 75/12

(52) U.S. Cl. ..... 337/50; 337/46; 337/45; 335/23; 335/35; 200/243

(58) Field of Search ..... 337/3, 6, 16, 10, 337/50, 59, 149, 45–49; 335/6, 16, 23, 35; 200/243, 244, 336, 339

(56) References Cited

U.S. PATENT DOCUMENTS 4,733,211 A * 3/1988 Castonguay et al. ..... 335/192
4,910,485 A * 3/1990 Bolongeat-Mobleu et al. ... 335/195
5,030,804 A * 7/1991 Abri ..... 200/323
5,313,180 A * 5/1994 Vial et al. ..... 335/16
5,357,066 A * 10/1994 Morel et al. ..... 200/17 R
6,084,489 A * 7/2000 Castonguay et al. ..... 335/167
6,114,641 A * 9/2000 Castonguay et al. ..... 200/244
6,281,461 B1 8/2001 Doughty ..... 218/154
6,310,307 B1 * 10/2001 Ciarcia et al. ..... 200/244
6,326,868 B1 * 12/2001 Kranz et al. ..... 335/8
6,366,438 B1 * 4/2002 Bauer ..... 361/115
6,373,357 B1 4/2002 Douville et al. ..... 335/172
6,388,547 B1 5/2002 Castonguay et al. ..... 335/172
6,403,901 B1 * 6/2002 Boeder et al. ..... 200/244
6,426,688 B1 7/2002 DeVizzi et al. ..... 335/16
6,429,760 B1 8/2002 Greenberg et al. ..... 335/202
6,466,117 B2 10/2002 Castonguay et al. ..... 335/172
6,542,057 B2 4/2003 Douville et al. ..... 335/172
6,590,172 B1 7/2003 Gadre et al. ..... 200/244
6,590,482 B2 7/2003 Castonguay et al. ..... 335/172
6,791,440 B2 * 9/2004 Harmon et al. ..... 335/16
2004/0227598 A1 * 11/2004 Ciarcia et al. ..... 335/8

* cited by examiner

*Primary Examiner*—Anatoly Vortman
(74) *Attorney, Agent, or Firm*—Cantor Culburn LLP

(57) ABSTRACT

An electrically isolated rotor assembly for a cassette assembly of a circuit breaker includes a rotor having a first side and an opposing second side, a first isolation cap disposed on the first side, a second isolation cap disposed on the second side. Each isolation cap preferably includes a centrally located knob with a bushing surrounding each knob, wherein the bushings are sized for securement within apertures within first and second cassette half pieces.

21 Claims, 6 Drawing Sheets

ISOLATION CAP AND BUSHING FOR CIRCUIT BREAKER ROTOR ASSEMBLY

BACKGROUND OF THE INVENTION

This invention relates generally to circuit breakers, and, more particularly, this invention relates to a rotor assembly with electrical isolation.

A current limiting circuit breaker is generally a high current circuit interrupting device capable of substantially limiting the duration and the intensity of current destined to flow in a circuit experiencing short circuit fault. To limit the duration and the intensity of short circuit currents, a circuit breaker must, within the shortest possible time, separate its contacts. This separation of the contacts is achieved by rapidly accelerating movable contact arms through an open gap. Upon the intense overcurrent conditions that result in the separation of the contacts, however, arcing often occurs between various parts in the circuit breaker. Arcing between the contacts is usually extinguished by passing the arc through an arc dissipating means. However, arcing may occur between other components of the circuit breaker as well.

Rotary contact arrangements are typically rotatably arranged on a support shaft between the fixed contact arms of the circuit breaker and function to interrupt the flow of current in the event that a short circuit occurs. A rotary contact arrangement employs a rotor and a pair of rotor springs to maintain contact between the movable contact arms and the fixed contact arms, thus maintaining a good electrical connection between the contacts. The compression forces provided by the rotor springs must be overcome when the contacts become separated and the circuit "blows open" due to the occurrence of opposing electrodynamic repulsion fields between the movable contact arm and the fixed contact arm.

Commonly, multiple contacts, each disposed within a cassette, are arranged within a circuit breaker system for protection of individual phases of current. The operating mechanism is positioned over one of the cassettes and generally connected to all of the cassettes in the system. Because of the close position between each of the cassettes, and between each cassette and the operating mechanism, the spacing between poles of opposite polarity could lead to dielectric failure.

BRIEF SUMMARY OF THE INVENTION

The above discussed and other drawbacks and deficiencies are overcome or alleviated by an electrically isolated rotor assembly for a circuit breaker. The electrically isolated rotor assembly includes a rotor having a first side and an opposing second side, a first isolation cap disposed on the first side, a second isolation cap disposed on the second side, and means for preventing dislocation of the first and second isolation caps from the rotor during rotation of the rotor.

In other embodiments, a cassette assembly for a circuit breaker includes a first cassette half piece having an interior surface, a first aperture formed on the interior surface, a second cassette half piece having an interior surface facing the interior surface of the first cassette half piece, and an electrically isolated rotor assembly trapped between the first and second cassette half pieces. The electrically isolated rotor assembly includes a rotor having a first side and an opposing second side, a first isolation cap disposed on the first side, the first isolation cap having a first centrally located knob facing the first cassette half piece, and a first bushing surrounding the first knob, wherein the first bushing is sized for securement within the first aperture within the first cassette half piece and wherein the rotor is rotatable within the cassette assembly about a pivot created by the first bushing, first knob, and first aperture.

In other embodiments, an isolation cap and bushing for a rotor assembly, includes an isolation cap having an exterior surface, an interior surface for facing the rotor assembly, an outer periphery having a lip for extending towards the rotor assembly, a centrally located knob on the exterior surface, and a bushing having a circular member concentrically surrounding the knob.

The above discussed and other features and advantages of the present invention will be appreciated and understood by those skilled in the art from the following detailed description and drawings.

DETAILED DESCRIPTION OF THE INVENTION

Figure 1:
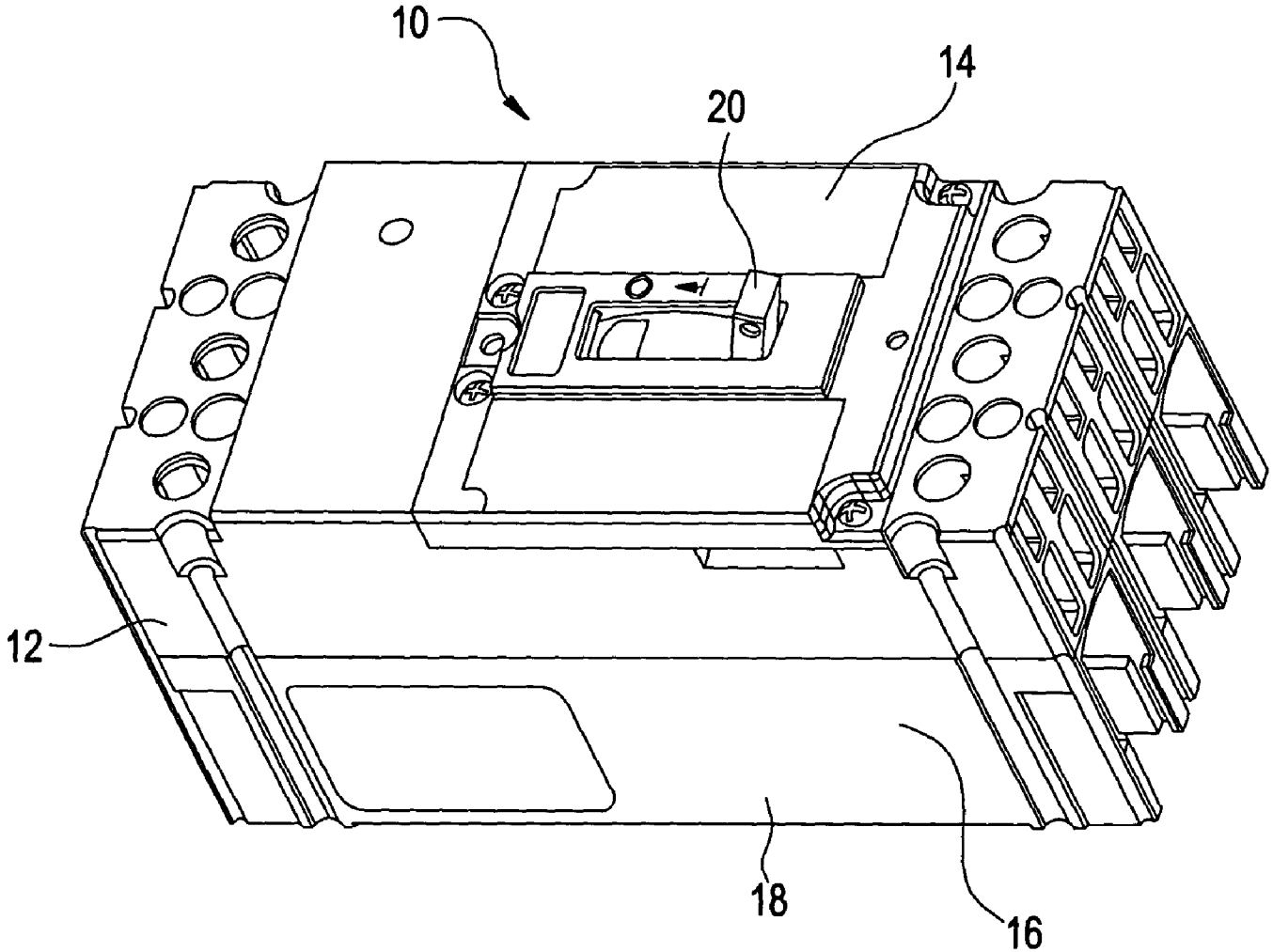
FIG. 1 shows a perspective view of a circuit breaker.
Figure 3:
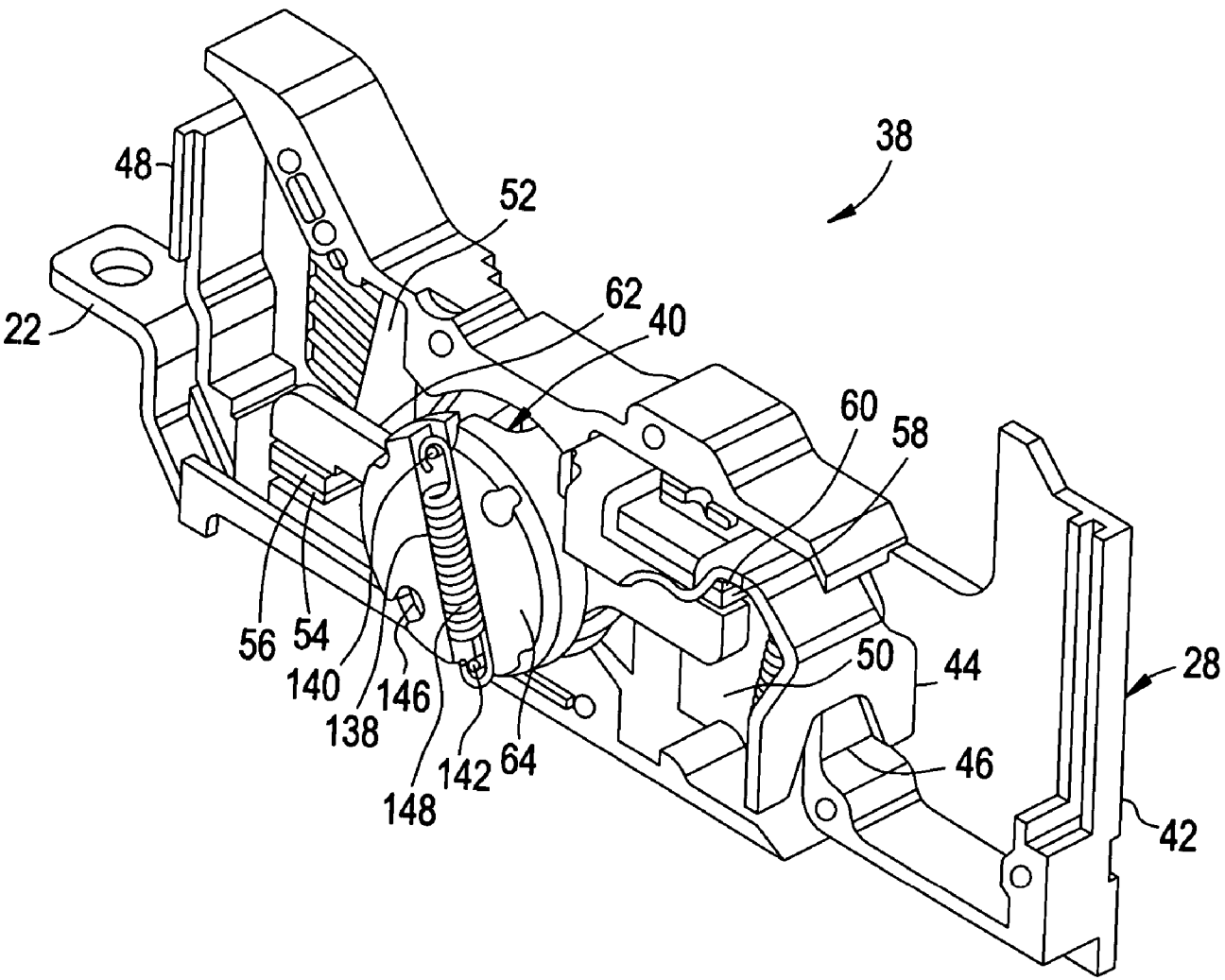
FIG. 3 shows a perspective view of a circuit breaker cassette assembly.

Referring to FIG. 1, an embodiment of a molded case circuit breaker 10 is generally shown. Circuit breakers of this type generally have an insulated case 16 having a cover 14 attached to a mid-cover 12 coupled to a base 18. A handle 20 extending through cover 14 gives the operator the ability to turn the circuit breaker 10 "on" to energize a protected circuit (as shown in FIG. 3), turn the circuit breaker "off" to disconnect the protected circuit (not shown), or "reset" the circuit breaker after a fault (not shown). A plurality of line-side contact and load-side straps also extend through the case 16 for connecting the circuit breaker 10 to the line and load conductors of the protected circuit. The circuit breaker 10 in FIG. 1 shows a typical three phase configuration, however, the present invention is not limited to this configuration but may be applied to other configurations, such as one, two, four, or more phase circuit breakers.

Figure 2:
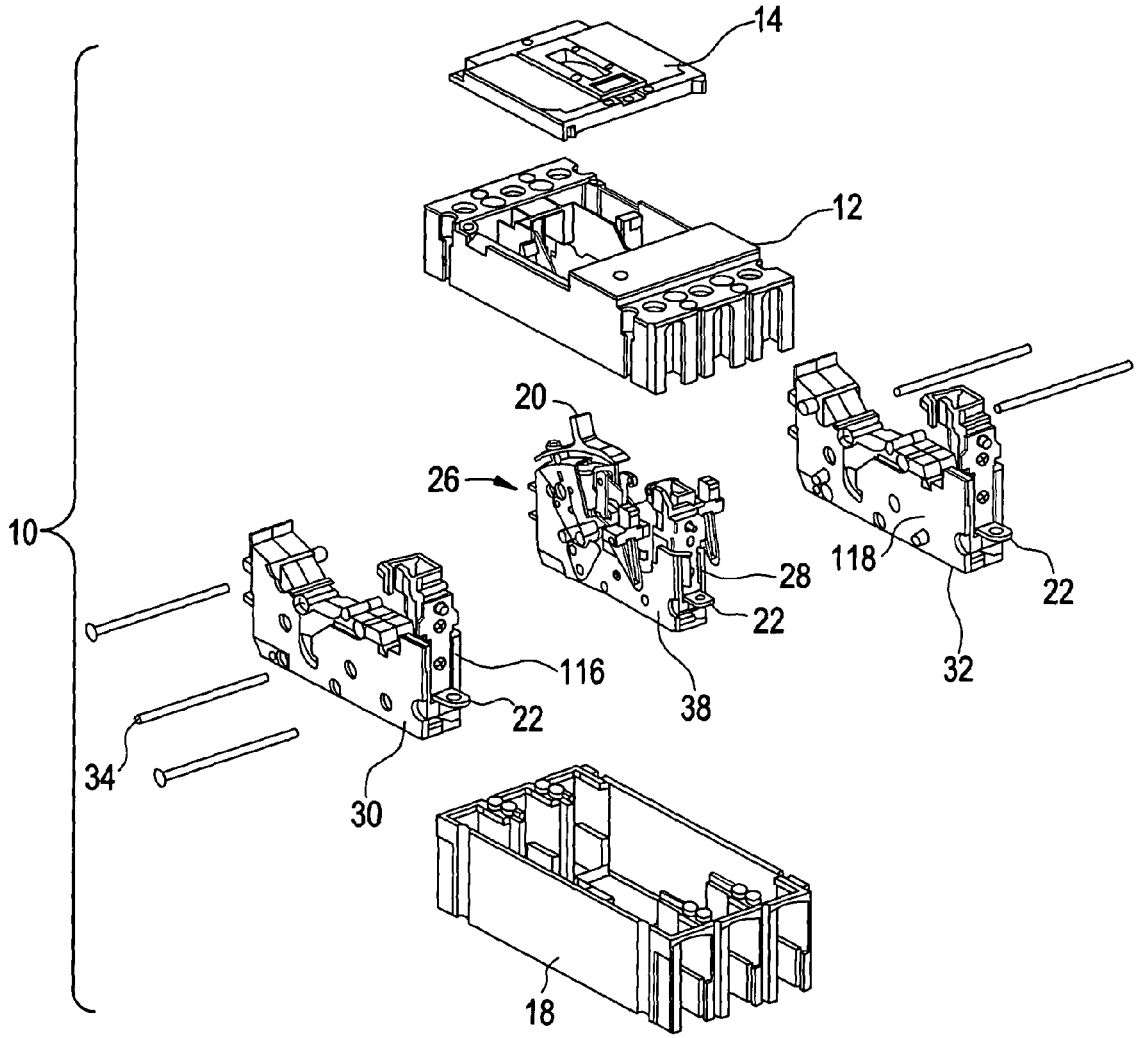
FIG. 2 shows an exploded view of the circuit breaker of FIG. 1.

Referring to FIG. 2, the handle 20 is attached to a circuit breaker operating mechanism 26. The circuit breaker operating mechanism 26 is coupled with a center cassette 28 and is connected with outer cassettes 30 and 32 by drive pin 34. The cassettes 28, 30, and 32 along with the circuit breaker operating mechanism 26 are assembled into base 18 and retained therein by the mid-cover 12. The mid-cover 12 is connected to the base 18 by any convenient means, such as screws, snap-fit (not shown) or adhesive bonding (not shown). A cover 14 is attached to the mid-cover 12 by screws or other attachment devices.

Referring to FIG. 3, a circuit breaker cassette assembly 38 is shown and comprises a rotary contact assembly, shown generally at 40, in a first electrically insulative cassette half-piece 42 of center cassette 28 intermediate a line-side contact strap 22, and a load-side contact strap 44. Line-side contact strap 22 is electrically connectable to line-side wiring (not shown) in an electrical distribution circuit, and load-side contact strap 44 is electrically connectable to load-side wiring (not shown) via a lug (not shown) or a mechanism such as a bimetallic element or current sensor (not shown). Electrically insulative shields 46, 48 separate load-side contact strap 44 and line-side contact strap 22 from the associated arc chute assemblies 50, 52, respectively. Although only a single circuit breaker cassette assembly 38 is shown, a separate circuit breaker cassette assembly 38 is employed for each pole of a multi-pole circuit breaker and operated in a manner similar to that of circuit breaker cassette assembly 38.

Electrical transport through rotary contact assembly 40 of circuit breaker cassette assembly 38 occurs from line-side contact strap 22 to an associated first fixed contact 54, through first and second movable contacts 56, 58 secured to the ends of a movable contact arm, shown generally at 62, and to an associated second fixed contact 60 on load-side contact strap 44. Movable contact arm 62 is pivotally arranged between two halves of a rotor 64 and moves in conjunction with rotor 64 upon manual articulation of rotor 64. Rotor 64 is rotatably positioned on a rotor pivot axle, the ends of which are supported by inner parallel walls of electrically-insulative cassette half-pieces 42.

The circular rotor 64 includes a contact spring slot 148 formed on each side thereof. A first contact spring 138 extends between a pair of spring pins 140, 142 within contact spring slot 148 and a second contact spring (not shown) extends between pins 140, 142 in a similar manner on the opposite side of rotor 64. An aperture 146 extends through rotor 64. Aperture 146 allows for a link connection by means of an extended rotor pin or drive pin 34 with the circuit breaker operating mechanism to allow a manual intervention for opening and closing the circuit breaker contacts.

The arc chute assemblies 50, 52 are positioned in the first electrically insulative cassette half piece 42 adjacent the respective pairs of first fixed and first moveable contacts 54, 56, and second fixed and second moveable contacts 60, 58. The first and second movable contacts 56, 58 and moveable contact arm 62 move through a passageway provided by the arc chute assemblies 50, 52 in order to engage and disengage from the respective first and second fixed contacts 54, 60. Each arc chute assembly 50, 52 is adapted to interrupt and extinguish the arc which forms when the circuit breaker 10 is tripped and the first and second moveable contacts 56, 58 are suddenly separated from the first and second fixed contacts 54, 60.

Referring back to FIG. 2, it should be understood that circuit breaker cassette assemblies 116, 118, that include cassettes 30, 32, respectively, are similarly constructed to circuit breaker cassette assembly 38 including rotary contact assembly 40 described herein.

Figure 4:
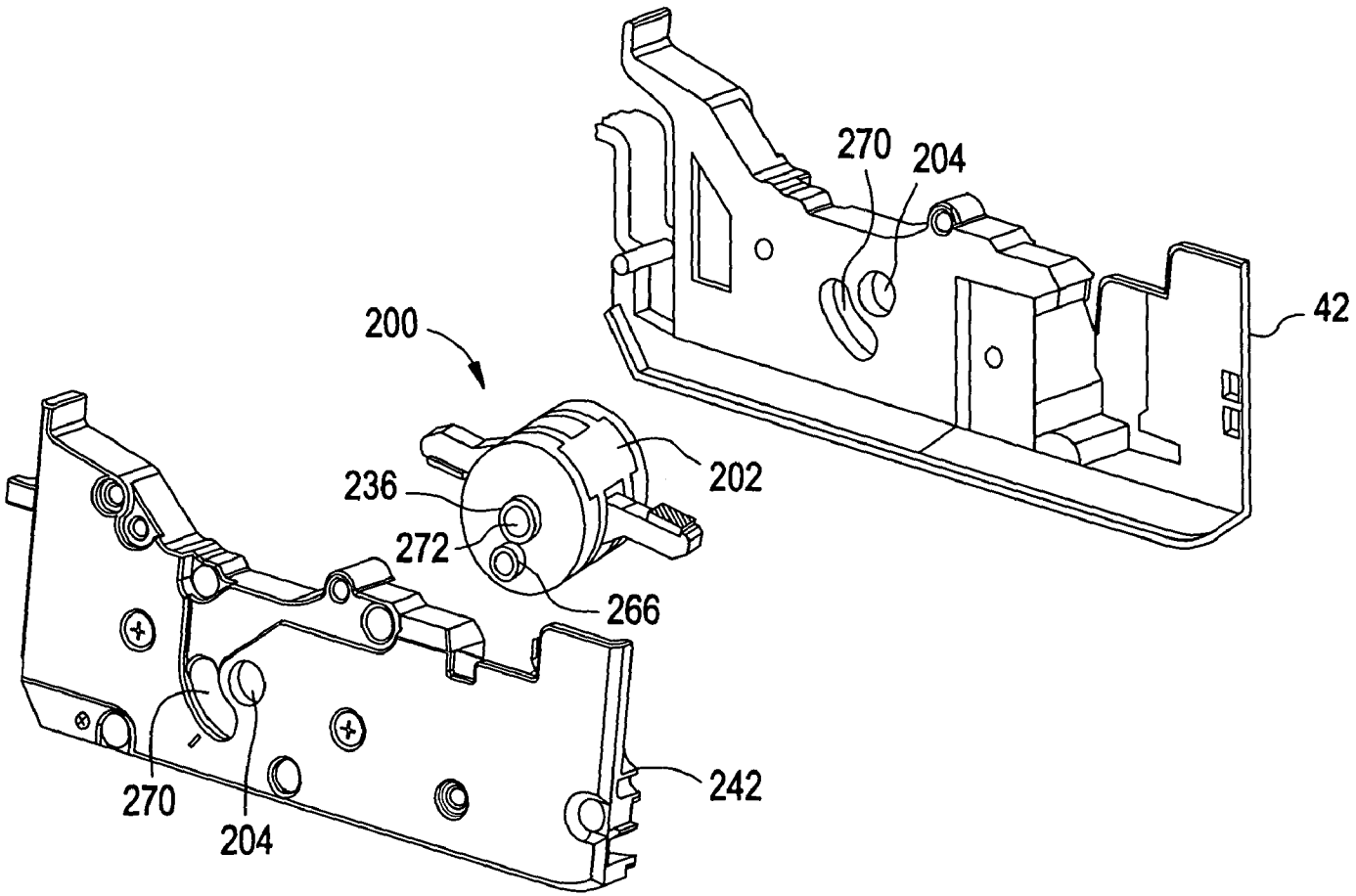
FIG. 4 shows an exploded view of the cassette and a revised rotor assembly including an isolation cap and a bushing.

Turning now to FIG. 4, it is shown that the first insulative cassette half piece 42 is paired with a second insulative cassette half piece 242 to house an electrically isolated rotor assembly 200. The electrically isolated rotor assembly 200 includes a rotor assembly 202 which operates in a functionally similar manner to the rotor 64 described in FIG. 3. In both first and second insulative cassette half pieces 42, 242 is an aperture 204 for receiving a bushing 234, 236 as will be further described in FIGS. 5 and 6. The bushings 234, 236 interact with apertures 204 in the cassette half pieces 42, 242 as will also be further described.

Figure 5:
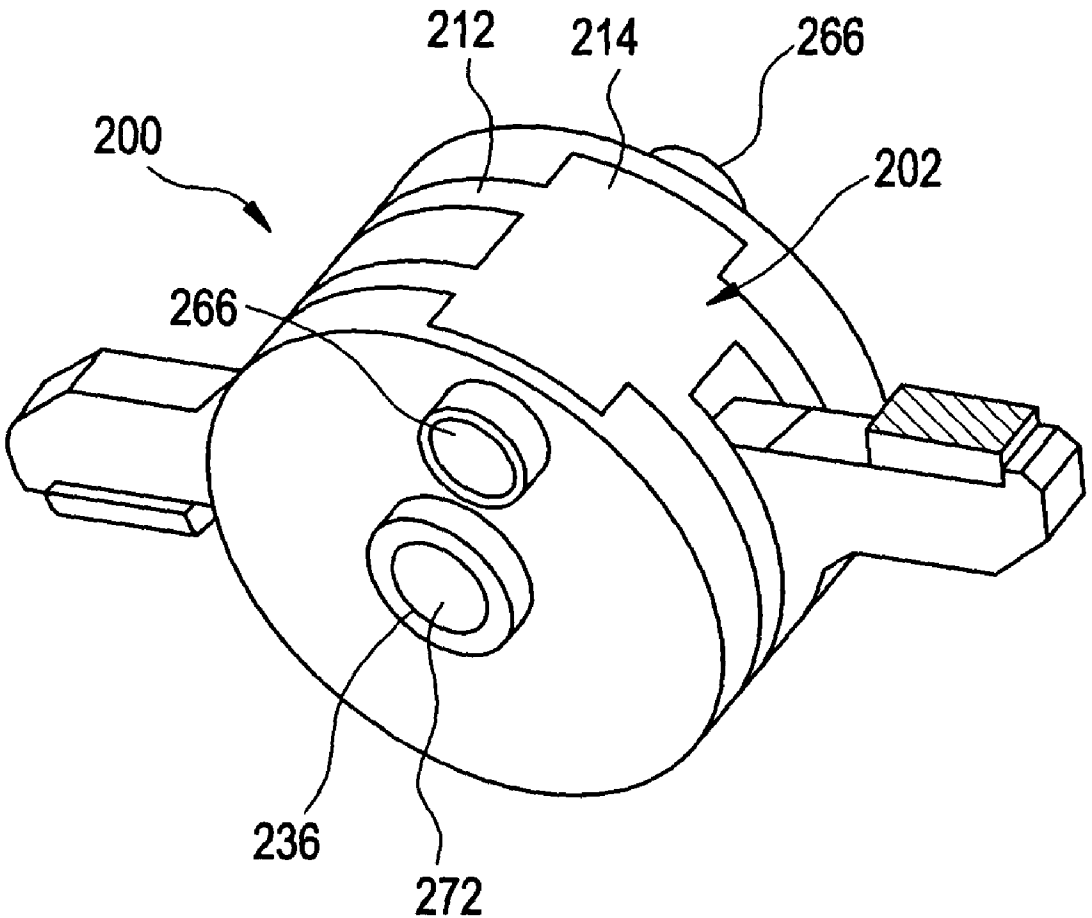
FIG. 5 shows a perspective view of the assembly of the rotor of FIG. 4 along with the isolation cap and bushing; and, FIG. 6 shows an exploded view of the isolation cap and the bushing of FIGS. 4 and 5 in relation to the rotor.
Figure 6:
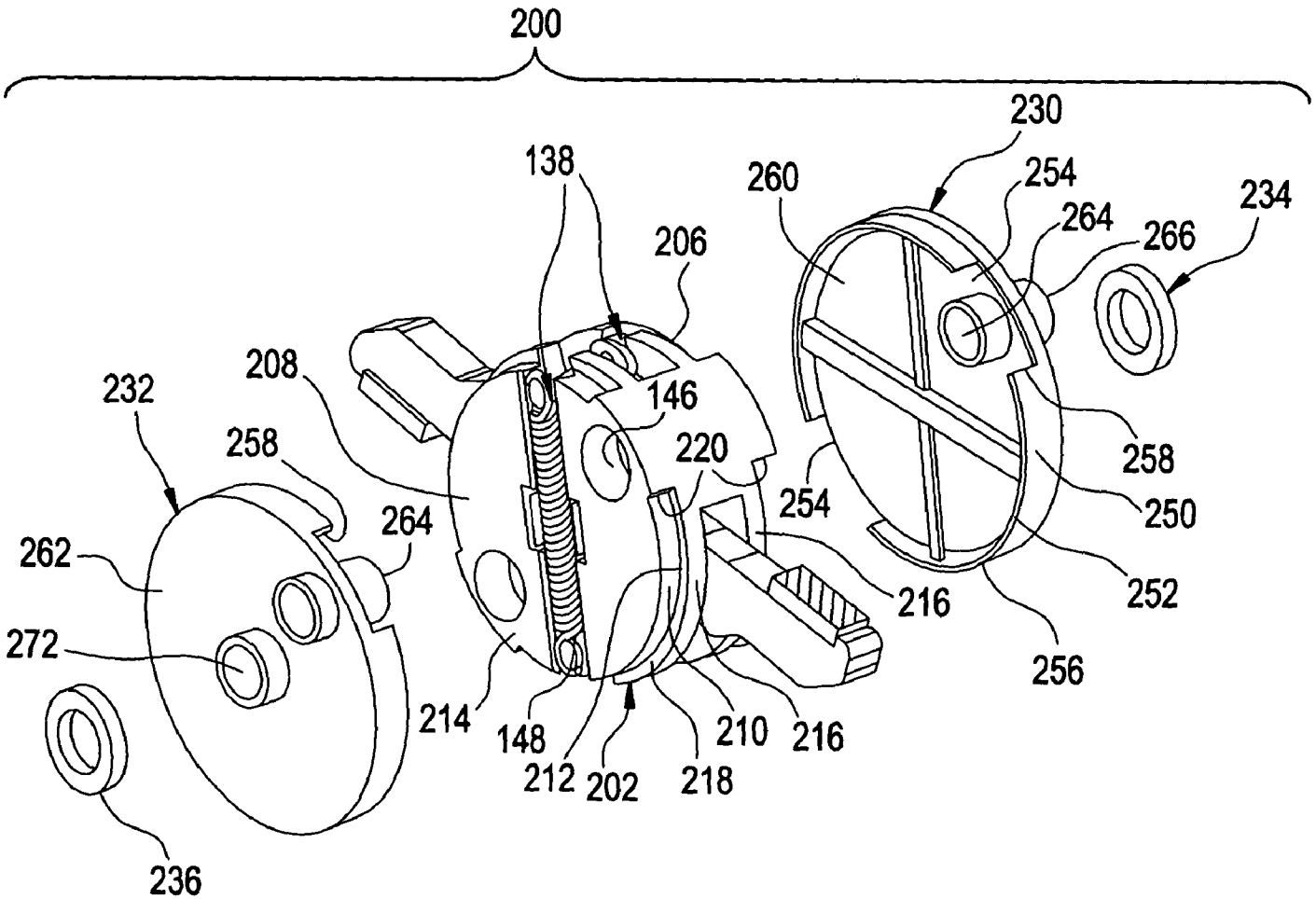

Turning now to FIGS. 5 and 6, the electrically isolated rotor assembly 200 includes a rotor assembly 202 having a first side 206 facing the half piece 42 and a second side 208 facing the half piece 242. It should be understood that the first and second sides 206 and 208 may be substantially the same, and therefore details described with respect to one side may apply to the other side. Furthermore, the first and second sides 206, 208 each include first and second contact spring slots 148 housing first and second contact springs 138 extending between a pair of spring pins 140, 142 as described with respect to FIG. 3. One or more apertures 146 may extend through the rotor assembly 202 for allowing a link connection by means of an extended rotor pin or drive pin, such as pin 34, with the circuit breaker operating mechanism. The rotor or drive pin 34 interconnects the cassettes within the circuit breaker.

Each side 206, 208 of the rotor assembly 202 also preferably includes an outer periphery 210 including intermittent indentations 212 and protrusions 214. That is, in the generally circular rotor assembly 202, a radius of the rotor assembly 202 measured at the location of an indentation 212 will be less than a radius of the rotor assembly 202 measured at the location of a protrusion 214. Furthermore, as shown in FIG. 6, the rotor assembly 202 may include two protrusions 214 which are diametrically opposite from one another along the outer periphery 210. Although two protrusions 214 are shown, it should be understood that more or less protrusions 214 may be formed along the outer periphery 210. Rotor assembly abutting surfaces 220 are formed on the outer periphery 210 where the indentations 212 end and the protrusions 214 begin.

The rotor assembly 202 may further include an inner periphery 216 where the indentations 212 are not included and thus the radius of the rotor assembly 202 is the same as that of the outer periphery 210 at the location of a protrusion 214. A stopping surface 218 is thus created between the outer periphery 210 at the location of an indentation 212 and the inner periphery 216.

The rotor assembly 202 is flanked by a pair of isolation caps 230, 232 which each include a bushing 234, 236, respectively, to form the electrically isolated rotor assembly 200. The first and second isolation caps 230, 232, and first and second bushings 234, 236 may be identical for reducing manufacturing expenses. The first isolation cap 230 is sized for secure placement upon the first side 206 of the rotor assembly 202. Likewise, the second isolation cap 232 is sized for secure placement upon the second side 208 of the rotor assembly 202. That is, when the caps 230, 232 are placed upon first and second sides 206, 208, the caps 230, 232 lie flush with the rotor assembly 202. Each isolation cap 230, 232 preferably includes an outer periphery 252 with an outer radius that may be substantially equal to the outer radius of the rotor assembly at the location of a protrusion 214 on the outer periphery 212 or at the inner periphery 216 of the rotor assembly 202. Each isolation cap 230, 232 further includes an inner periphery 252 which is interrupted by gaps 254. The inner periphery 252 may have an inner radius substantially the same, or slightly greater than, an outer radius of the outer periphery 210 of the rotor assembly 202 at the location of an indentation 212 such that the isolation cap fits securely over the rotor assembly 202 by having the inner periphery 252 of the isolation caps 230, 232 overlap the outer periphery 210 of the rotor assembly 202. The isolation caps 230, 232 further include an edge periphery 256 which abuts against the stopping surface 218 of the rotor assembly 202 when the isolation caps 230, 232 are securely installed. The inner periphery 252 further includes isolation cap abutting surfaces 258 which push against the rotor assembly abutting surfaces 220 when the rotor assembly 202 rotates. Likewise, the rotor assembly abutting surfaces 220 abut against the isolation cap abutting surfaces 258 when the rotor assembly 202 rotates. This feature prevents the isolation caps 230, 232 from slipping relative to the rotor assembly 202 during swift and sudden rotations of the rotor assembly 202.

The isolation caps 230, 232 further each include an inner surface 260 which faces the first side 206, and the second side 208, respectively of the rotor assembly 202, and an outer surface 262 which faces an interior of the cassette half pieces 42 and 242. The inner surfaces 260 of the isolation caps 230, 232 cover the springs 138. Additionally, the inner periphery 252 of the isolation caps 230, 232 covers the opposite end portions of the springs 138 where they are secured via the pins 140, 142. The isolation caps 230, 232 are preferably made from thermoset plastic with superior arc track resistance to serve as a contamination seal to the live parts of the rotor assembly 202, and to provide electrical dielectric integrity between poles of opposite polarity to greater than 2500 Volts after short circuit. Although the use of thermoset plastic is described, it should be understood that the use of other materials with suitable insulative properties would also be within the scope of this system 200. Because of the design of the isolation caps 230, 232, dimensional stability is provided to the rotor assembly 202 and the contact arm assembly in all phases of operation.

The inner surface 260 also includes at least one inwardly protruding pipe 264 that is sized for receipt within the aperture or apertures 146. A complimentary externally protruding pipe 266 extends from the outer surface 262. The externally protruding pipe 266 may be received within the slotted apertures 270 formed within each cassette half piece 42, 242. A longitudinal axis is aligned with the apertures 146, and pipes 264, 266 such that the rotor pin or drive pin 34 passes freely therethrough and the longitudinal axis of the drive pin 34 is aligned with the longitudinal axis passing through the aperture 146 and pipes 264, 266. The pipes 264 and 266 extending from the isolation caps 230, 232 help protect the drive pin 34 as it moves through the slotted apertures 270 during rotation of the rotor assembly 202. Also, the pipes 264, 266 offer support to the drive pin 234 and also act as a "poke-yoke" feature. The pipes 264, 266 prevent the rotor system from getting assembled upside down.

On the outer surface 262 of each isolation cap 230, 232 there is preferably provided a centrally located, exteriorly protruding knob 272. A longitudinal axis passing through the knob 272 defines a pivot axis for the rotor assembly 202. Surrounding an outer periphery of each knob 272, there is preferably provided a bushing 234, 236. Each bushing is sized to fit within each aperture 204 provided on the interior of each cassette half piece 42, 242, as shown in FIG. 4. The knobs 272 and bushings 234, 236 act as a bearing surface within the apertures 204, allowing the rotor assembly 202 to rotate freely within the slotted aperture 270 via pin 34. The bushings 234, 236 are preferably plastic with very low friction factors such that the combination of the bushings 234, 236 and the isolation caps 230, 232 form a low friction and wear resistant pivot for the rotor assembly 202 during mechanical endurance. The bushings 234, 236 may be made from Zytel® nylon resin from DuPont. Nylon is a thermoplastic polymer, while the isolation caps 230, 232 may be made from a thermoset polymer. The separate bushings 234, 236 prevent the knobs 272 and caps 230, 232 from becoming eroded when rotating inside the aperture.

While a specific embodiment of a circuit breaker is shown, it should be understood that this system may be retrofitted in other molded case circuit breakers based on the construction of the rotor system.

The electrically isolated rotor assembly 200 thus provides electrical isolation between the live parts in the rotor assembly 202 and live parts of adjacent poles of opposite polarity. Also, the electrically isolated rotor assembly 200 provides a bearing pivot that results in minimal wear during mechanical operation. Also, the electrically isolated rotor assembly 200 provides a seal to prevent arcing contamination from the rotor springs 138 that could lead to dielectric failure between poles of opposite polarity.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. An assembly for a circuit breaker, the assembly comprising:

a rotor having a first side and an opposing second side, an aperture in the rotor for receiving a rotor pin;

a first isolation cap disposed on the first side;

a second isolation cap disposed on the second side, each isolation cap including an interiorly protruding pipe extending at least partially within the aperture; and, means for preventing dislocation of the first and second isolation caps from the rotor during rotation of the rotor.

2. The assembly of claim 1 further comprising:

a first cassette half piece having an interior surface, a first aperture formed on the interior surface;

a second cassette half piece having an interior surface facing the interior surface of the first cassette half piece;

the rotor, first isolation cap, and second isolation cap trapped between the first and second cassette half pieces.

3. The assembly of claim 2 wherein the first isolation cap includes a first centrally located knob facing the first cassette half piece, the assembly further comprising a first bushing surrounding the first knob, wherein the first bushing is sized for securement within the first aperture within the first cassette half piece and wherein the rotor is rotatable within the assembly about a pivot created by the first bushing, first knob, and first aperture.

4. The assembly of claim 3 wherein the first bushing is made from a material distinct and different than a material forming the first isolation cap, the material forming the first bushing has a lower coefficient of friction than the material forming the first isolation cap.

5. The assembly of claim 2 from the first and second cassette half pieces.

6. The assembly of claim 1 further comprising an exteriorly protruding pipe extending from each isolation cap, the aperture, the interiorly protruding pipes, and the exteriorly protruding pipes all sharing a common longitudinal axis.

7. The assembly of claim 6, further comprising a first cassette half piece, wherein the first cassette half piece includes a slotted opening, the exteriorly protruding pipe of the first isolation cap movable within the slotted opening.

8. The assembly of claim 1 wherein the means for preventing dislocation during rotation comprises an abutment between a rotor abutment surface and an isolation cap abutment surface.

9. The assembly of claim 1, wherein the first isolation cap comprises:

an exterior surface, wherein a first centrally located knob is located on the exterior surface;

an interior surface for facing the rotor;

an outer periphery having a lip for extending towards the rotor;

and the assembly further comprising a bushing, the bushing including a circular member concentrically surrounding the knob.

10. The assemble of claim 9 wherein the bushing is made from a material having a lower coefficient of friction than the first isolation cap.

11. An assembly for a circuit breaker, the assembly comprising:

a rotor having a first side and an opposing second side;

a first isolation cap disposed on the first side, the first isolation cap having an interior surface facing the rotor and an exterior surface, a first centrally located knob positioned on the exterior surface of the first isolation cap;

a second isolation cap disposed on the second side; and, a bushing surrounding the knob, wherein the bushing includes a circular member.

12. The assembly of claim 11 wherein the interior surface of the first isolation cap includes an interior surface which covers a spring housed in the rotor, the first isolation cap farther having an outer periphery which covers opposite ends of the spring.

13. The assembly of claim 11 wherein the first isolation cap includes an outer periphery which has an inner radius substantially equal to an outer radius of the rotor at an indentation area of an outer periphery of the rotor.

14. The assembly of claim 11 wherein the bushing is made from a material distinct and different from a material forming the first isolation cap.

15. The assembly of claim 14 wherein the material forming the bushing has a lower coefficient of friction than the material forming the first isolation cap.

16. The assembly of claim 15 wherein the bushing is made of plastic.

17. The assembly of claim 11 further comprising means for preventing dislocation of the first and second isolation caps from the rotor during rotation of the rotor including an abutment between a rotor abutment surface and an isolation cap abutment surface on the first isolation cap.

18. The assembly of claim 17 wherein the rotor abutment surface is provided on an outer periphery of the rotor, the outer periphery having an indentation area and a protrusion area, the indentation area having an outer radius smaller than an outer radius of a protrusion area, wherein the rotor abutment surface is provided between the indentation area and the protrusion area.

19. The assembly of claim 18 wherein the isolation cap abutment surface is provided on an outer periphery of the isolation cap, the outer periphery of the isolation cap having a gap, the isolation cap abutment surface provided at a beginning of a gap.

20. An assembly for a circuit breaker, the assembly comprising:

a rotor having a first side and a second side;

a first cassette half piece having an interior surface;

an isolation cap positioned between the rotor and the interior surface of the first cassette half piece, wherein the rotor and isolation cap are movable within the first cassette half piece with respect to a pivot axis of the rotor; and, a bushing positioned between the isolation cap and the interior surface of the first cassette half piece, wherein the bushing surrounds the pivot axis and protects the isolation cap from erosion during rotation of the isolation cap within the first cassette half piece.

21. The assembly of claim 20, wherein the isolation cap electrically isolates a spring within the rotor.

* * * * *